US007429953B2

(12) United States Patent
Buris et al.

(10) Patent No.: US 7,429,953 B2
(45) Date of Patent: Sep. 30, 2008

(54) PASSIVE REPEATER FOR RADIO FREQUENCY COMMUNICATIONS

(75) Inventors: Nicholas E. Buris, Deer Park, IL (US); Richard S. Rachwalski, Lemont, IL (US); William J. Turney, Schaumburg, IL (US)

(73) Assignee: Motorola, Inc., Schaumburg, IL (US)

( * ) Notice: Subject to any disclaimer, the term of this patent is extended or adjusted under 35 U.S.C. 154(b) by 59 days.

(21) Appl. No.: 11/367,895

(22) Filed: Mar. 3, 2006

(65) Prior Publication Data

US 2007/0205946 A1 Sep. 6, 2007

(51) Int. Cl.
*H01Q 1/38* (2006.01)

(52) U.S. Cl. ..... 343/700 MS

(58) Field of Classification Search ..... 455/7, 455/11.1, 14; 343/700 MS, 880, 881
See application file for complete search history.

(56) References Cited

U.S. PATENT DOCUMENTS 3,657,652 A 4/1972 Smith
4,001,834 A 1/1977 Smith
5,262,590 A 11/1993 Lia
5,600,333 A * 2/1997 Justice et al. ..... 343/713
6,232,923 B1 5/2001 Guinn et al.
2002/0119748 A1 8/2002 Prax et al.
2004/0110469 A1 * 6/2004 Judd et al. ..... 455/15
2004/0192285 A1 9/2004 Capobianco et al.

FOREIGN PATENT DOCUMENTS

WO WO01024407 A1 * 5/2001

OTHER PUBLICATIONS

NSF Award to Enhance RFID Tags, RF Design; Jun. 21, 2005.

* cited by examiner

*Primary Examiner*—Hoang V Nguyen
*Assistant Examiner*—Robert Karacsony

(57) ABSTRACT

A passive repeater includes: a connecting transmission circuit having first and second opposing ends and made of a flexible material for substantially conforming to a portion of a structure, the structure having first and second opposing sides; first and second antenna elements respectively coupled to the first and second opposing ends of the connecting transmission element; and first and second affixing elements respectively coupled to the first and second antenna elements for attaching the first and second antenna elements to the first and second opposing sides of the structure, wherein the first and second antenna elements are operable to transfer a signal from the first opposing side of the structure to the second opposing side of the structure via the connecting transmission circuit.

20 Claims, 2 Drawing Sheets

300

PASSIVE REPEATER FOR RADIO FREQUENCY COMMUNICATIONS

FIELD OF THE INVENTION

The present invention relates generally to passive repeaters and more specifically to the use of passive repeaters to transfer radio frequency (RF) signals between a transmitter and receiver when a structure is located therebetween that interferes with the transmission of such signals.

BACKGROUND OF THE INVENTION

In RF communications, there are instances especially within buildings and in connection with other structures such as walls or containers where these structures create a barrier to the transmission of the RF signals. Many illustrations of such RF shielding may be envisioned. However, two such scenarios will be described by way of illustration only.

First, the use of RF identification and wireless sensor technology is spreading in the supply chain and transportation industries. Goods equipped with RF tags and sensors are nested within larger containers for transport. Typical intermodal cargo containers are constructed with steel that creates an RF barrier which limits access to the tags and sensors to the times when the containers are open, loaded, or unloaded. A solution that allows access to the tags and sensors from outside the container at any time is an attractive feature from both a logistics and a security standpoint. For all practical purposes, a metallic cabinet also acts as a RF shield for tagged items inside it. So, the term container used in this document is used to also refer to traditional metallic cabinets, or drawers.

Moreover, wireless services are often lost when a subscriber enters an elevator, since the elevator car creates an effective RF barrier. Improvements in the quality of service are always pursued by wireless service providers for competitive reasons, so a solution which offers uninterrupted access to in-building wireless services when a subscriber enters an elevator can be very compelling. Given the existing number of containers and elevators in use today, a low cost solution such as an improved passive repeater that is easily installed and does not require modification to the container or elevator is needed.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION OF THE INVENTION

Figure 1:
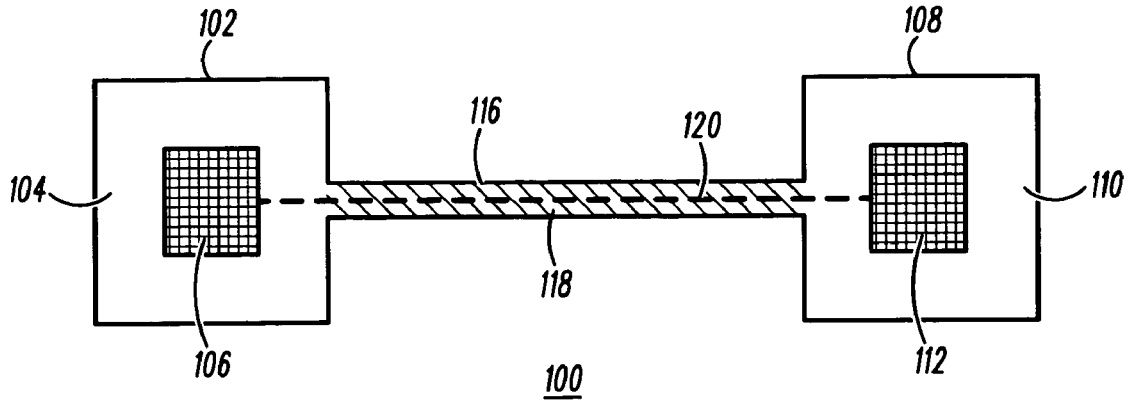
FIG. 1 illustrates a passive repeater in accordance with an embodiment of the present invention.

Before describing in detail embodiments that are in accordance with the present invention, it should be observed that the embodiments reside primarily in combinations of method steps and apparatus components related to a method and apparatus for a passive repeater for radio frequency communications. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

Generally speaking, pursuant to the various embodiments, a passive repeater is described that may be implemented using low cost flex circuitry, for example. The repeater can be easily installed on a structure without necessarily having to modify the structure and includes: a connecting transmission circuit having first and second opposing ends and made of a flexible material for substantially conforming to a portion of a structure, the structure having first and second opposing sides; first and second antenna elements respectively coupled to the first and second opposing ends of the connecting transmission element; and first and second affixing elements respectively coupled to the first and second antenna elements for attaching the first and second antenna elements to the first and second opposing sides of the structure, wherein the first and second antenna elements are operable to transfer a signal from the first opposing side of the structure to the second opposing side of the structure via the connecting transmission circuit.

In one embodiment the antenna elements also comprise a flexible material and form an integral unit with the transmission circuit. The repeater may accommodate a single band or may be multi-band and may be substantially planar for ease of installing the repeater through openings in the structure and for further maximizing the area of the repeater that attaches and conforms to the structure. Those skilled in the art will realize that the above recognized advantages and other advantages described herein are merely exemplary and are not meant to be a complete rendering of all of the advantages of the various embodiments of the present invention.

Referring now to the drawings, and in particular FIG. 1, a passive repeater in accordance with an embodiment of the present invention is shown and indicated generally at 100. Repeater 100 comprises an antenna element 102, an antenna element 108 and a connecting transmission circuit 116 having opposing ends with one end coupled to antenna element 102 and the other end coupled to antenna element 108. When installed on a structure that interferes with the transmission of a signal (e.g., an RF signal) between two transceivers, one antenna element collects RF energy from a transmitter on one side of the structure. This RF energy is transferred to the other antenna element via the transmission circuit, and the other antenna element re-radiates the RF energy on another side of the structure toward a receiver. The two surfaces of a structure to which the antenna elements are attached are generally referred to herein as "opposing sides", which is defined herein to include: a first surface that is inside of an enclosed structure and a second surface that is outside of the enclosed structure, wherein the first and second surfaces may be at any angle to each other (i.e., at any angle from zero degrees to 360°); and a first surface on a barrier that is not part of an enclosed structure and a second surface on the barrier, wherein the first and second surfaces may be at any angle to each other.

Turning first to the connecting transmission circuit 116, this circuit is constructed having a predetermined shape and dimensions (e.g., sufficiently thin and flat) and comprising a flexible material to enable the circuit to be easily inserted through an existing seam or opening of a structure (if necessary) without physically modifying the structure and to enable the circuit to be substantially conformed to a portion of a structure in a manner that causes no mechanical interference at the seam of the structure. As will be seen in more detail below, seams that exist around a door or access panel or between wall, floor and/or ceiling panels provide potential installation points. Herein, substantially conformed means that at least a portion of the transmission circuit is bent or flexed to conform to the shape (and/or dimensions) of a portion of a structure to an extent needed to enable (or not interfere with) the continued proper functioning of the portion and/or to an extent needed to enable (or not interfere with) the proper functioning of the passive repeater.

As stated above, connecting transmission circuit 116 is comprised of a flexible material such as the thin flexible substrate used in flex circuits, wherein conductive ink is typically printed on the substrate to form the conductive traces of the circuit. Since processes for manufacturing flex circuits are well known in the art, the details of such processes will not be included herein for the sake of brevity. However, in a flex circuit embodiment, transmission circuit 116 would comprise a plurality of layers that could be formed by appropriately folding the substrate along predetermined lines to create the multiple layers and allow for appropriately thick dielectrics to be used. A suitable adhesive layer between the circuit's multiple layers could be used to maintain structural integrity of the circuit, and high density interconnect (HDI) techniques, such as inductive loading of a ground plane, could also be employed to realize wider traces since the substrate would be very thin. Alternatively, the multilayer construction of repeater 100 could be realized using more conventional printed circuit board techniques employing vias, but at an increased cost.

In the embodiment illustrated in FIG. 1, connecting transmission circuit 116 comprises signal traces arranged in a stripline cable configuration having a metallic conductor panel on a first side (not shown) of circuit 100, a dielectric overlaying this conductor panel, circuit trace elements 120 embedded in the dielectric and another metallic conductor panel 118 (shown shaded) overlaying the dielectric and circuit trace elements. Trace elements 120 facilitate the transmission of a radio frequency (RF) signal from one antenna element to the other antenna element, and the two conductive panels provide for a ground plane for the trace elements. A stripline configuration provides a controlled impedance in many environments and provides a shielded transmission circuit that is insensitive to its installation environment. However, in an alternative embodiment, connecting transmission circuit trace elements 120 can be arranged in a microstrip configuration. A microstrip configuration is similar to a stripline configuration and includes all of the above-described elements as in the stripline configuration except for the panel 118.

Antenna elements 102, 108 can be manufactured and implemented in a variety of ways depending on the particular application for which the passive repeater is used, the manufacturing processes including those described above for manufacturing the transmission circuit. In the embodiment illustrated in FIG. 1, the antenna elements are bi-directional and are each single (band) patch antennas manufactured from the same continuous piece of substrate as the connecting transmission circuit 116 and, thus, form an integral unit with the connecting transmission circuit. However, those of ordinary skill in the art will understand that in an alternative embodiment, the antenna elements can be formed from a substrate material that is separate from the substrate material from which the connecting transmission circuit is formed, wherein the separate antenna elements would be operably connected to the connecting transmission circuit for facilitating the transmission of the RF signals between two transceivers separated by the RF signal barrier.

In accordance with a microstrip construction, antenna elements 102, 108 each comprise a first conducting panel (not shown), a dielectric layer 104, 110 overlaying this conductive panel and a conductive patch 106, 112 on top of the dielectric layer. Patch antenna elements 102, 108 are illustrated as single patch element operable to transfer RF signals over a single frequency band. One or both of the patch antennas may in another embodiment be operable to accommodate multiple air interfaces to transfer RF signals over multiple frequency bands by, for example, being constructed as a stacked patch antenna as is well known in the art. In further embodiments, one or more of the antenna elements may be constructed as a dipole antenna element, a slot antenna element, or a spiral antenna element as is also well known in the art.

Passive repeater 100 further comprises at least two affixing elements (not shown) attached respectively to the conductive panel of antenna element 102 and antenna element 108 (i.e., attached to the reverse side of the antenna elements 102, 108). The affixing elements are used to attach the repeater to a structure. In an embodiment, repeater 100 may further comprise an affixing element attached to a conductive panel of the transmission element, which lies in the same plane as the antenna conductive panels to which the two other affixing elements are attached. This additional affixing element may be a separate piece from the other affixing elements or an integral piece formed from one contiguous piece of material.

The affixing elements can be constructed using any suitable means. For example in one low cost implementation, one or more of the affixing elements may comprise an adhesive element that includes, for instance, a polyimide film or a paper material with adhesive on both sides, wherein one side of the adhesive is affixed to a conductive panel and the other side of the adhesive is affixed to another piece of material (e.g., polyimide film, paper, etc.). When attaching the repeater to a structure, for example in accordance with FIG. 3 as described in detail below, this piece of material can be removed so that the adhesive underneath can be attached to a surface of the structure.

In an alternative embodiment, one or more of the affixing elements may be implemented as a magnetic structure having, for instance, a first and second substantially planar magnetic element (that magnetically couple to each other), wherein one of the magnetic elements is non-magnetically (e.g., via an adhesive) attached to a conductive panel and the other magnetic element is generally (although not necessarily) magnetically coupled to the structure. Other embodiments of affixing elements include, but are not limited to, a Velcro structure having two pieces with one piece affixed to a conductive panel and the other to a surface of the structure so that the mating of the two Velcro pieces attaches the repeater to the structure. Any suitable latching mechanism may also comprise one or more of the affixing elements and is within the scope of the teachings herein.

Further, optionally, comprising repeater 100 (but not shown for ease of illustration) are transition circuits that couple and complete electrical connections between the transmission circuit and the antenna elements coupled on each of its opposing ends. For example, where as illustrated in FIG. 1, the transmission circuit is of a stripline construction, and the antenna element is of a microstrip construction the conducting traces of the transmission circuit and the conducting patch of the antenna element may be located on separate layers that are coupled together using a transition circuit that comprises layers of substrate and conductive material that form suitable traces and/or conductive vias to complete the electrical connection between the transmission circuit and antenna elements.

The dimensions of the antenna elements and the connecting transmission circuit comprising repeater 100 are predetermined based on a number of factors. Those factors include, but are not limited to, the manufacturing process and corresponding materials used to manufacture the antenna elements and transmission circuit, the radio frequencies accommodated, the expected strength of the RF signals being transferred from one opposing side of the structure to the other opposing side based on, for example, the distance of the antenna elements from a transceiver source located beyond either or both of the opposing sides of the structure, etc.

Generally, as shown in FIG. 1, at least one conductive panel within the same plane as each of the antenna elements and the transmission circuit is substantially planar (or flat) to better facilitate a maximum area of the transmission circuit conforming to the shape and/or dimensions of a portion of the structure and to better facilitate a maximum area of the antenna elements attaching to the surface of the structure. Moreover, where the antenna elements are likewise flexible the antenna elements being flat facilitate a maximum area of the antenna elements conforming to the shape and/or dimensions of the structure.

From the bottom conductive layers to the top of the antenna elements and transmission circuit, the thickness or height may be substantially the same thickness, as in the embodiment illustrated in FIG. 1 wherein the primary difference in thickness (between the antenna elements and the transmission circuit) is based on the antenna elements lacking a top conductive panel. In an alternative embodiment, it may be desirable for the thickness of the antenna elements to exceed the thickness of the transmission circuit, for example where the antenna elements support multiple air interfaces or for improved bandwidth and efficiency performance.

In addition, it is desirable that the dimensions of the antenna elements and transmission circuit are such that the repeater does not interfere mechanically with the structure (such as the opening and closing of doors and access panels) and such that the repeater can be inserted through an existing opening in the structure without physically modifying the structure. For example, where the structure is enclosed and includes an opening or slot having a given height, it would be desirable that the height of the repeater at its thickest point be less than the height of the slot. In addition, it is desirable that the relevant portions of the repeater to be inserted through the opening have dimensions capable of being conformed to a shape having an effective cross-section that is smaller than a cross-section of the opening.

Figure 2:
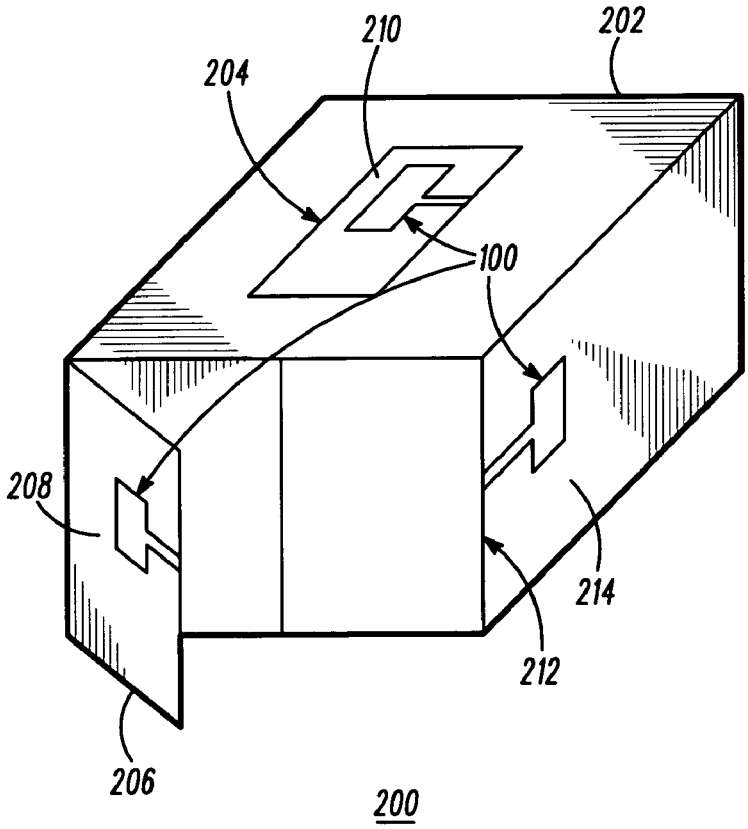
FIG. 2 illustrates apparatus comprising passive repeaters affixed to a structure in accordance with an embodiment of the present invention.

Turning now to FIG. 2, apparatus in accordance with an embodiment of the present invention is shown and generally indicated at 200. Apparatus 200 comprises an exemplary structure 202 having attached thereto passive repeaters 100 as described above. Structure 202 is of a construct such that it acts as an RF shield for RF signals attempted to be transmitted from one opposing side of the structure to another opposing side of the structure. For instance, structure 202 may be comprised of various metals that affect RF shielding.

Structure 202, as illustrated, is an enclosed structure which may be, for example, an inter-modal container housing products that each has affixed thereto an RFID tag or may be an elevator that may hold a person using a communication device that transmits and receives RF signals. However, the application of the principles of the invention described herein is not limited to these types of enclosed structures. A repeater in accordance with embodiments of the present invention may be attached to other types of enclosed structures such as rooms that may be encased in metal or attached to different kinds of structures that are not enclosed such as walls.

FIG. 2 illustrates exemplary areas on an enclosed structure to which a repeater in accordance with embodiments of the present invention can be attached. A repeater 100 can be attached to a door 206 of structure 202 with one antenna element attached on the outside 208 of the door and the other antenna element (not shown) attached on the inside of the door and having the transmission circuit substantially conforming to the shape and dimensions of the portion of the door between the inside and outside of the door, wherein an angle of, for example, substantially 360° is traversed by the transmission circuit. The transmission circuit ideally has a thickness such that it does not interfere with the door being in its completely closed position and is flexible enough to be bent to an angle of substantially 360°. Moreover, when in its completely closed position, one antenna element is located on the outside of the enclosed structure and the other on the inside of the enclosed structure. The antenna element on the outside surface of the structure transfers RF signals between a transceiver located outside the structure and the other antenna element inside the structure via the transmission circuit. Likewise, the antenna element on the inside of the structure transfers RF signals between a transceiver located inside the structure and the other antenna element outside the structure via the transmission circuit.

A repeater in accordance with embodiment of the present invention can in addition to or in the alternative be attached through a door jamb 212 of the enclosed structure with one antenna element attached on an outside surface 214 of the structure perpendicular to the plane of the doorjamb and the other antenna element (not shown) attached on an inside surface of the structure perpendicular to the door jamb and having the transmission circuit substantially conforming to the shape and dimensions of the portion of the door between the inside surface and outside surface of the structure, which is an angle traversed by the transmission circuit. Again, the transmission circuit ideally has a thickness such that it does not interfere with the door being in its completely closed position and is sufficiently flexible to be bent at an angle from substantially zero degrees to substantially 360°. The first and second above-described positioning of the repeater 100 is useful, for example, when the enclosed structure is a container having doors or is a room.

In a third positioning, the repeater 100 is attached to an access panel 204 (such as may be found on an elevator, for instance) with one antenna element attached on the outside 210 of the access panel and the other antenna element (not shown) attached on the inside of the access panel and having the transmission circuit substantially conforming to the shape and dimensions of the portion of the access panel between the inside and outside of the access panel wherein an angle of, for example, substantially 360° is traversed by the transmission circuit. The transmission circuit ideally has a thickness such that it does not interfere with the access panel being in its completely closed position and is flexible enough to be bent to an angle of substantially 360°.

Figure 3:
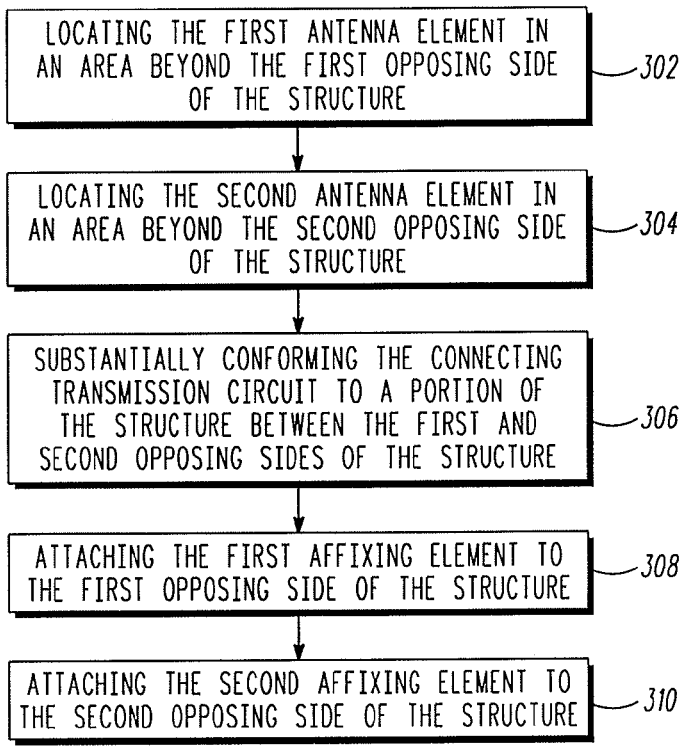
FIG. 3 illustrates a flow diagram of a method for affixing a passive repeater to a structure in accordance with an embodiment of the present invention.

FIG. 3 illustrates a method 300 in accordance with an embodiment of the present invention for attaching or mounting the novel passive repeater to any type of structure. In steps 302 and 304, one antenna element is located on one opposing side of the structure and the other antenna element is located on the other opposing side of the structure. For example as mentioned above, one antenna element and a portion of the transmission circuit could be inserted through a slot or opening in the structure without modifying the structure or substantially bending the repeater. Door jambs are an example of such openings, but a structure may comprises other types of slots or openings including openings caused by modifying (e.g., drilling or cutting) the structure to create an opening for inserting the repeater if an adequate one does not exist or if the functional integrity of the structure in an area near an existing opening might be compromised by the placement of a repeater.

Figure 4:
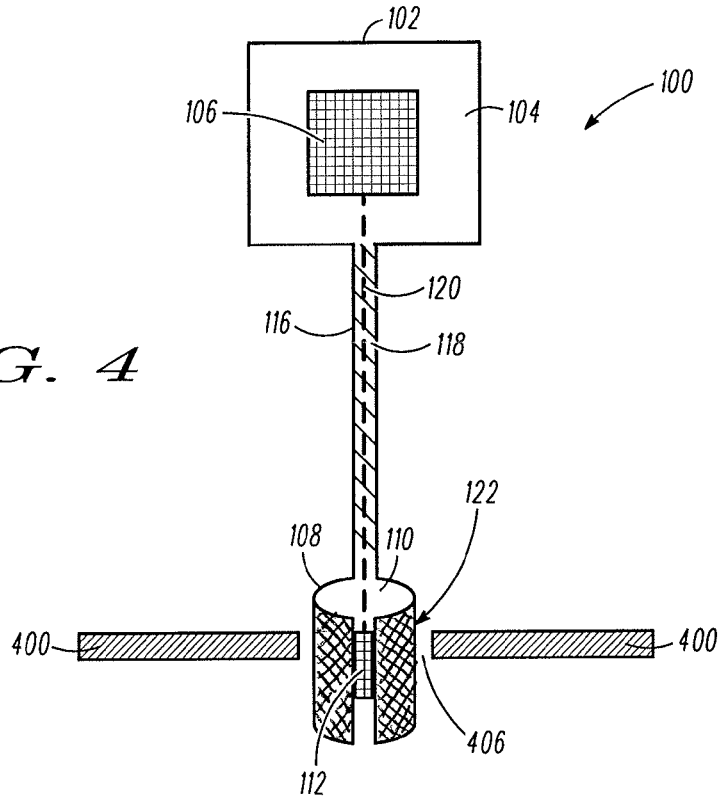
FIG. 4 illustrates a manner of inserting a passive repeater into an opening in a structure to affix the repeater to a structure in accordance with an embodiment of the present invention.

In addition as illustrated in FIG. 4, one antenna element 108 could be rolled (in this implementation with the affixing element 122 attached to the conductive panel and facing the surface of the structure opening 406 so as to protect the conductive panel, the dielectric layer 110 and the conductive patch 112) into a shape having a cross-section that is smaller than a cross-section of the shape of the opening 406 in the structure portion 400. Those skilled in the art will realize that where the repeater is being attached to a door, access panel or side of a wall, for instance, locating the antenna elements in areas beyond the two opposing sides of the structure does not require inserting any portion of the repeater through an opening in the structure.

At a step 306, the transmission circuit is substantially conformed to a portion of the structure between the two opposing sides in a manner described above. Finally, at steps 308 and 310, the affixing elements are attached to the opposing sides of the structure to secure the repeater in place. Once installed, the antenna elements operate to transfer RF signals between the two opposing sides of the structure (e.g., between the outside and inside of an enclosed container or room, or around a wall) via the transmission circuit. The installation examples given above are directed toward an embodiment of the novel repeater wherein the antenna elements and transmission circuit are pre-assembled. However, applications where the passive repeater is assembled (e.g., the antenna elements are operably coupled to the transmission circuit) during installation on the structure are also within the scope of the teachings herein.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, or contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes or contains the element. The terms "a" and "an" are defined as one or more unless explicitly stated otherwise herein. The terms "substantially", "essentially", "approximately", "about" or any other version thereof, are defined as being close to that understood by one of ordinary skill in the art, and in one non-limiting embodiment the term may be defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. A passive repeater comprising:

a connecting transmission circuit having first and second opposing ends and comprised of a first flexible material for substantially conforming to a shape of a portion of a structure, the portion of the structure including portions of first and second opposing sides of the structure and an opening passing through the structure, wherein a first surface of the portion of the first opposing side is at an angle to a second surface of the portion of the second opposing side, and wherein the connecting transmission circuit has a thickness less than a cross-section of the opening and can flexibly conform to the shape of the portion of the structure by the first flexible material of the connecting transmission circuit bending through the angle and passing through the opening so that a first portion of the connecting transmission circuit which includes the first opposing end thereof planarly overlies a portion of the first surface and a second portion of the connecting transmission circuit which includes the second opposing end thereof planarly overlies a portion of the second surface;

first and second antenna elements respectively coupled to the first and second opposing ends of the connecting transmission element wherein each of the first and second antenna elements has a first shape that is substantially planar and a size larger than the opening, and wherein at least one of the first and second antenna elements comprises a second flexible material having a degree of flexibility to allow bending of the at least one of the first and second antenna elements to a second shape having an effective cross-section that is smaller than the cross-section of the opening in order to be inserted through the opening and, after being bent to the second shape, will return to the first shape; and first and second affixing elements respectively coupled to the first and second antenna elements for attaching the first and second antenna elements to the first and second surfaces of the respective first and second opposing sides of the structure, wherein the first and second antenna elements are operable to transfer a signal from the first opposing side of the structure to the second opposing side of the structure via the connecting transmission circuit.

2. The passive repeater of claim 1, wherein the first and second antenna elements are comprised of the second flexible material, and wherein the first flexible material and the second flexible material are a same flexible material.

3. The passive repeater of claim 2, wherein the first and second antenna elements and the connecting transmission circuit comprise an integral unit.

4. The passive repeater of claim 1, wherein the first and second antenna elements are each at least one of spiral antenna elements, slot antenna elements and printed antenna elements.

5. The passive repeater of claim 1, wherein the first and second antenna elements are each one of single and stacked patch antenna elements.

6. The passive repeater of claim 1, wherein the first and second affixing elements comprise at least one of an adhesive element, a magnetic structure, a Velcro structure and a latching mechanism.

7. The passive repeater of claim 1, wherein the connecting transmission circuit comprises a stripline constructed connecting transmission circuit.

8. An apparatus comprising:

a structure having first and second opposing sides and an opening through the structure from the first opposing side to the second opposing side, wherein the first opposing side includes a first surface at an angle less than three hundred and sixty degrees to a second surface of the second opposing side; and a passive repeater, the passive repeater comprising:

a connecting transmission circuit having first and second opposing ends and comprised of a first flexible material, wherein the connecting transmission circuit has a thickness less than a cross-section of the opening;

first and second antenna elements each having a first shape that is substantially planar and a size larger than the opening through the structure, the first and second antenna elements comprised of a second flexible material having a degree of flexibility allowing the first and second antenna elements to be bent to a second shape having an effective cross-section that is smaller than a cross-section of the opening in order to be inserted through the opening and, after being inserted through the opening, returning to the first shape, wherein the first and second antenna elements are respectively coupled to the first and second opposing ends of the connecting transmission circuit to form an integral unit with the connecting transmission circuit; and first and second affixing elements respectively coupled to the first and second antenna elements and attaching the first and second antenna elements to the first and second opposing sides of the structure such that the connecting transmission circuit substantially conforms to a portion of the structure by being bent to the angle so that a first portion of the connecting transmission circuit includes the first opposing end and planarly overlies the first surface of the first opposing side of the structure and a second portion of the connecting transmission circuit includes the second opposing end and planarly overlies the second surface of the second opposing side of the structure and a third portion of the connecting transmission circuit between the first portion and the second portion passes through the opening through the structure, wherein the first and second antenna elements are operable to transfer a signal from the first opposing side of the structure to the second opposing side of the structure via the connecting transmission circuit.

9. A method for affixing a passive repeater to a structure having first and second opposing sides, the first opposing sides including a first surface and the second opposing side including a second surface at an angle to the first surface, and the passive repeater comprising a connecting transmission circuit having first and second opposing ends and comprised of a flexible material, first and second antenna elements respectively coupled to the first and second opposing ends of the connecting transmission element, and first and second affixing elements respectively coupled to the first and second antenna elements, the method comprising the steps of:

locating the first antenna element and the second antenna element in an area beyond the first opposing side of the structure and near an opening through the structure;

inserting the second antenna element through the opening to locate the second antenna element in an area beyond the second opposing side of the structure;

substantially conforming the connecting transmission circuit to a portion of the structure including portions of the first and second opposing sides of the structure and the opening through the structure by bending the flexible material of the connecting transmission circuit through the angle so that a first portion of the connecting transmission circuit which includes the first opposing end planarly overlies the first surface of the first opposing side of the structure and a second portion of the connecting transmission circuit which includes the second opposing end planarly overlies the second surface of the second opposing side of the structure;

attaching the first affixing element to the first surface of the first opposing side of the structure such that the first antenna element is coupled to and planarly overlies the first surface of the first opposing side of the structure; and attaching the second affixing element to the second opposing side of the structure such that the second antenna element is coupled to and planarly overlies the second surface of the second opposing side of the structure.

10. The method of claim 9, wherein the opening is one of an existing opening through the structure and an opening through the structure created by modifying the structure.

11. The method of claim 9, wherein the step of inserting the second antenna through the opening comprises the steps of:

bending the second antenna element into a shape having a cross-section that is smaller than a cross-section of a shape of the opening; and inserting the second antenna element through the opening to locate the second antenna element in the area beyond the second opposing side of the structure.

12. The method of claim 11 wherein the step of bending the second antenna element comprises the step of rolling the second antenna into a circular shape having a cross-section that is smaller than the cross-section of the shape of the opening.

13. An apparatus comprising:

a structure having a portion including first and second opposing sides of the structure and a movable section thereof, wherein a first surface of the first opposing side is at an angle to a second surface of the second opposing side; and a passive repeater, the passive repeater comprising:

a connecting transmission circuit having first and second opposing ends and comprised of a flexible material for substantially conforming to a shape of the portion of the structure by the flexible material of the connecting transmission circuit bending through the angle so that a first portion of the connecting transmission circuit which includes the first opposing end thereof planarly overlies a portion of the first surface and a second portion of the connecting transmission circuit which includes the second opposing end thereof planarly overlies a portion of the second surface, the connecting transmission circuit passing through an opening within the portion of the structure near the movable section without interfering with movement of the movable section;

first and second antenna elements respectively coupled to the first and second opposing ends of the connecting transmission element; and first and second affixing elements respectively coupled to the first and second antenna elements for attaching the first and second antenna elements to the first and second surfaces of the respective first and second opposing sides of the structure, wherein the first and second antenna elements are operable to transfer a signal from the first opposing side of the structure to the second opposing side of the structure via the connecting transmission circuit.

14. The apparatus of claim 13, wherein at least one of the first and second antenna elements has a first shape that is larger than the opening, the at least one of the first and second antenna elements comprised of a flexible material having a degree of flexibility which allows the at least one of the first and second antenna elements to be bent from the first shape to a second shape having an effective cross-section less than a cross-section of the opening and, thereafter, naturally returning to the first shape.

15. The apparatus of claim 13, wherein the portion of the structure includes one or more of an access panel, a door, a doorjamb and a wall.

16. The apparatus of claim 15 wherein the movable section comprises the access panel.

17. The apparatus of claim 15 wherein the movable section comprises the door.

18. The apparatus of claim 13, wherein the first and second antenna elements and the connecting transmission circuit comprise an integral unit.

19. The apparatus of claim 13, wherein the first and second antenna elements are each at least one of spiral antenna elements, slot antenna elements and printed antenna elements.

20. The apparatus of claim 13, wherein the first and second antenna elements are each one of single and stacked patch antenna elements.

* * * * *